US005724054A

United States Patent [19]

Shinoda

[11] Patent Number: 5,724,054

[45] **Date of Patent: *Mar. 3, 1998**

[54] METHOD AND A CIRCUIT FOR GRADATIONALLY DRIVING A FLAT DISPLAY DEVICE

[75] Inventor: Tsutae Shinoda, Kawasaki, Japan

[73] Assignee: Fujitsu Limited, Kanagawa, Japan

[ * ] Notice: The term of this patent shall not extend beyond the expiration date of Pat. No. 5,541,618.

[21] Appl. No.: 674,161

[22] Filed: Jul. 1, 1996

Related U.S. Application Data

[62] Division of Ser. No. 405,920, Mar. 16, 1995, Pat. No. 5,541,618, which is a continuation of Ser. No. 181,959, Jan. 18, 1994, abandoned, which is a continuation of Ser. No. 799,255, Nov. 27, 1991, abandoned.

[30] Foreign Application Priority Data

Nov. 28, 1990 [JP] Japan ..... 2-331589

[51] Int. Cl.[6] ..... G09G 3/28

[52] U.S. Cl. ..... 345/60; 345/63; 345/68

[58] Field of Search ..... 345/60, 63, 68, 345/87; 313/169.1, 169.3, 169.4

[56] References Cited

U.S. PATENT DOCUMENTS

| | | |
|---|---|---|
| 3,886,403 | 5/1975 | Owaki et al. . |
| 3,906,290 | 9/1975 | Kurahashi et al. . |
| 3,972,040 | 7/1976 | Hilsum et al. . |
| 4,368,465 | 1/1983 | Hirakawa et al. . |
| 4,499,460 | 2/1985 | Pearson et al. . |
| 4,622,549 | 11/1986 | Criscimagna et al. . |
| 4,638,218 | 1/1987 | Shinoda et al. . |
| 4,716,341 | 12/1987 | Oida et al. . |
| 4,737,687 | 4/1988 | Shinoda et al. . |
| 5,030,888 | 7/1991 | Salavin et al. . |
| 5,575,716 | 11/1996 | Holz et al. . |

FOREIGN PATENT DOCUMENTS

| | | | |
|---|---|---|---|
| 0 157 248 | 10/1985 | European Pat. Off. . | |
| 0 366 117 | 5/1990 | European Pat. Off. . | |
| 49-115242 | 11/1974 | Japan . | |
| 51-32051 | 9/1976 | Japan . | |
| 56-94395 | 7/1981 | Japan | G09G 3/28 |
| 57-78771 | 5/1982 | Japan . | |
| 61-39341 | 2/1986 | Japan . | |
| 63-151997 | 6/1988 | Japan . | |
| 2 291 597 | 3/1990 | Japan . | |
| 2 219 092 | 8/1990 | Japan . | |

OTHER PUBLICATIONS

"Pulsed Bas Discharged Display With Memory" G.E. Holz Burroughs Corp., ECD, Plainfield, NJ pp. 36–37.

IEEE Transactions Of Electron Devices, "Low–Voltage Operated AC Plasma–Display Panels", Shinoda et al., vol. ED–26, No. 8, Aug. 1979, pp. 1163–1167.

1988 International Display Research Conference pp. 80–85, "A Generalized Addressing Technique for RMS Responding Matrix LCDS", T.N. Ruckhongathan.

*Primary Examiner*—Richard Hjerpe
*Assistant Examiner*—Amare Mengistu
*Attorney, Agent, or Firm*—Nikaido, Marmelstein, Murray & Oram LLP

[57] ABSTRACT

In a method and circuit of driving a flat display panel formed of a plurality of cells each having a memory function, where the cells are formed at cross points of a plurality of X-electrodes and a plurality of Y-electrode orthogonal to the X-electrodes, a period of a frame for displaying a single picture is divided into a plurality of sequential subframes. Each of the subframes comprises: an addressing period during which cells to be lit later in a display period are selected from all the cells by being written by having a wall charge therein; and the display period subsequent to the address period for lighting the selected cells by applying sustain pulses to all the cells. A number of the sustain pulses included in each display period is predetermined differently for each subframe according to a weight given to each subframe. Gradation of visual brightness of each cell is determined by the accumulated number of the sustain pulses included in the subframes that are selectively operated during a single frame according to a required brightness level for each cell. Thus, an adequate time length can be allocated to required number of subframes to achieve a quality brightness-gradation for each cell.

15 Claims, 8 Drawing Sheets

Fig.1
PRIOR ART
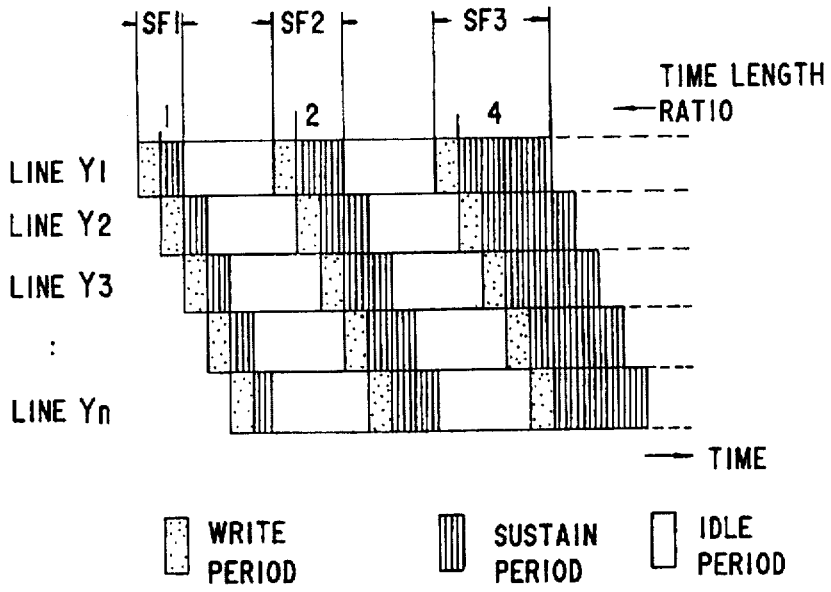
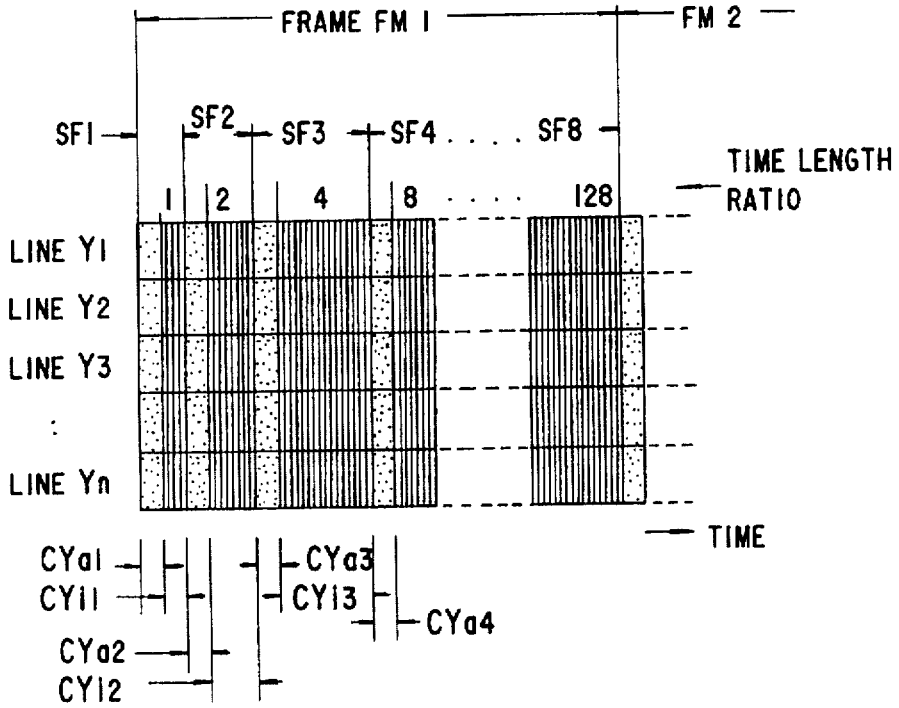
Fig.3
ADDRESS PERIOD
DISPLAY PERIOD

METHOD AND A CIRCUIT FOR GRADATIONALLY DRIVING A FLAT DISPLAY DEVICE

This is a divisional of application Ser. No. 08/405,920 filed on Mar. 16, 1995, now U.S. Pat. No. 5,541,611 which is a continuation application of Ser. No. 08/181,959 filed on Jan. 18, 1994, now abandoned, which is a continuation of application of Ser. No. 07/799,255 filed on Nov. 27, 1991, now abandoned.

BACKGROUND OF THE INVENTION

1. Field of the Invention

This invention relates to a method and apparatus for driving a flat display panel having a memory function, such as an AC-type PDP (plasma display panel), etc., to allow gradation, i.e. a gray scale, of its visual brightness for each cell.

2. Description of the Related Arts

Flat display apparatus, allowing a thin depth as well as a large picture display size, have been popularly employed, resulting in a rapid increase in its application area. Accordingly, there has been required further improvements of the picture quality, such as a gradation as high as 256 grades, so as to achieve the high-definition television, etc.

There have been proposed some methods for providing a gradation to the display brightness, such as Japanese Patent Publication 51-32051 or Hei2-291597, where a single frame period of a picture to be displayed is divided with time into plural subframes (SF1, SF2, SF3, etc.) each of which has a specific time length for lighting a cell so that the visual brightness of the cell is weighted. A typical prior art method to provide the gradation of visual brightness is schematically illustrated in FIG. 1, where after cells on a single horizontal line (simply referred to hereinafter as line) $Y_1$ are selectively written, i.e. addressed, cells on the next line $Y_2$ are then written. Structure of each subframe SFn on each scanned line, employed in an opposed-discharge type PDP panel, is shown in FIG. 2, where are drawn voltage waveforms applied across the cells on horizontal lines $Y_1$, $Y_2$ . . . $Y_n$, respectively. Each subframe is provided with a write period CYw (or address period) during which a write pulse Pw, an erase pulse Pf and sustain pulses Ps are sequentially applied to the cells on each Y-electrode, and a sustain period CYm during which only sustain pulses are applied.

The write pulse generates a wall charge in the cells on each line; and the erase pulse Pf erases the wall charge. However, for a cell to be lit a cancel pulse Pc is selectively applied to the cell's X-electrode $X_i$ concurrently to the erase pulse application so as to cancel the erase pulse Pf. Accordingly, the wall charge (see FIG. 10) remains only in the cell applied with the cancel pulse Pc, that is, where the cell is written. Sustain pulses Ps are concurrently applied to all the cells; however, only the cells having the wall charge are lit.

Gradation of visual brightness, i.e. a gray scale, is proportional to the number of sustain pulses that light the cells during a frame. Therefore, different time lengths of sustain periods CYm are allocated to the subframes in a single frame, so that the gradation is determined by an accumulation of sustain pulses in the selectively operated subframes each having different number of sustain pulses.

Problem in the prior art methods is in that the second subframe must wait the completion of the first subframe for all the lines creating an idle period on each line. Therefore, if the number of the lines m=400 and 60 frames per second to achieve 16 grades (n=4), the time length $T_{SF}$ allowed to a single subframe period becomes as short as about 10 μs as an average.

Because $T_{SF}\times60\times400\times4=1$ sec. For executing the write period and the sustain period in such a short period, the driving pulses must be of a very high frequency. For example, in the case where the numbers of sustain pulses are 1, 2, 4 and 8 pairs in the respective subframes to achieve 16 grades, the driving pulses must be as high as 360 kHz as derived from:

$$\text{freq.}=(1+2+4+8)\times60\times400=360\times10^3\ \text{Hz}.$$

The higher frequency drive circuit consumes the higher power, and allows less margin in its operational voltage due to the storage time of the wall charge, particularly in an AC type PDP. Moreover, the high frequency operation, such as 360 kHz, may cause a durability problem of the cell. Therefore, the operation frequency cannot be easily increased, resulting in a difficulty in achieving the gradation.

Furthermore, in the above prior art method, a write period CYw of a line must be executed concurrently to a sustain period CYm of another line. This fact causes another problem in that the brightness control, for example, the gradation control to meet gamma characteristics of human eye, cannot be desirably achieved.

SUMMARY OF THE INVENTION

It is a general object of the invention to provide a method and circuit which allow a high degree of gradation of visual brightness of a flat display panel by requiring less time for addressing cells to be lit.

According to a method and circuit of driving a flat display panel formed of a plurality of cells each having a memory function, each of the cells being formed at a cross point of a plurality of X-electrodes and a plurality of Y-electrode orthogonal to the X-electrodes, a period of a frame for displaying a single picture is divided into a plurality of sequential subframes. Each of the subframes comprises: an addressing period during which cells to be lit later in a display period are selected from all the cells by being written by having a wall charge therein; and the display period subsequent to the address period for lighting the selected cells by applying sustain pulses to all the cells. A number of the sustain pulses included in each display period is predetermined differently for each subframe according to a weight given to each subframe. Gradation of visual brightness of each cell is determined by the accumulated number of the sustain pulses included in the subframes which are selectively operated during a single frame according to the brightness level specified in a picture data to be displayed.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

FIG. 1 schematically illustrates a prior art structure of a frame to drive each line of a matrix display panel;

FIG. 2 schematically illustrate waveforms in the prior art frames;

FIG. 3 illustrates a structure of a frame of the present invention;

Figure 6:
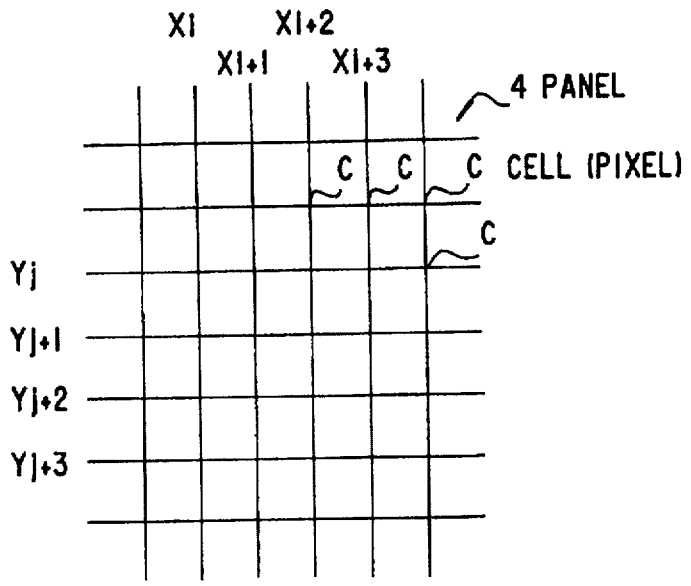
Figure 8:
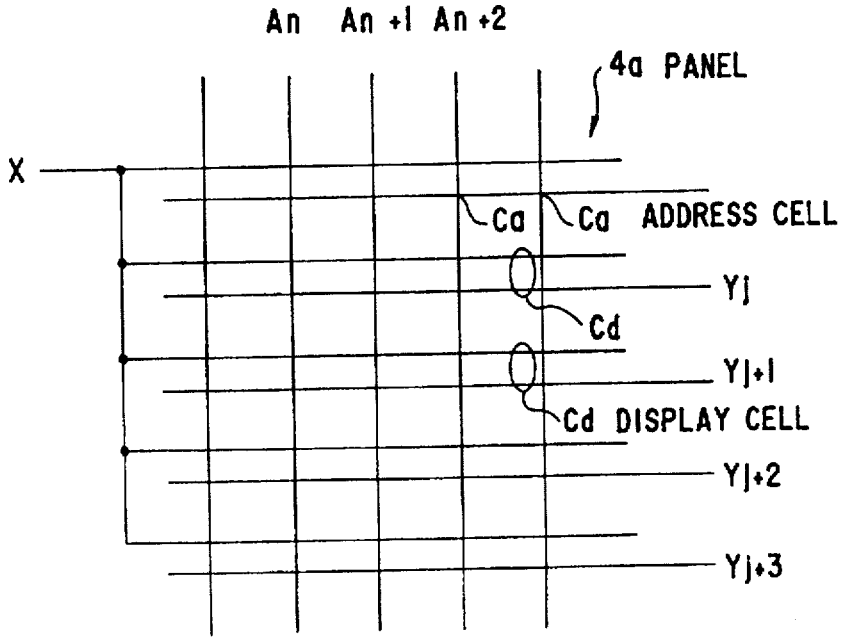
Figure 7:
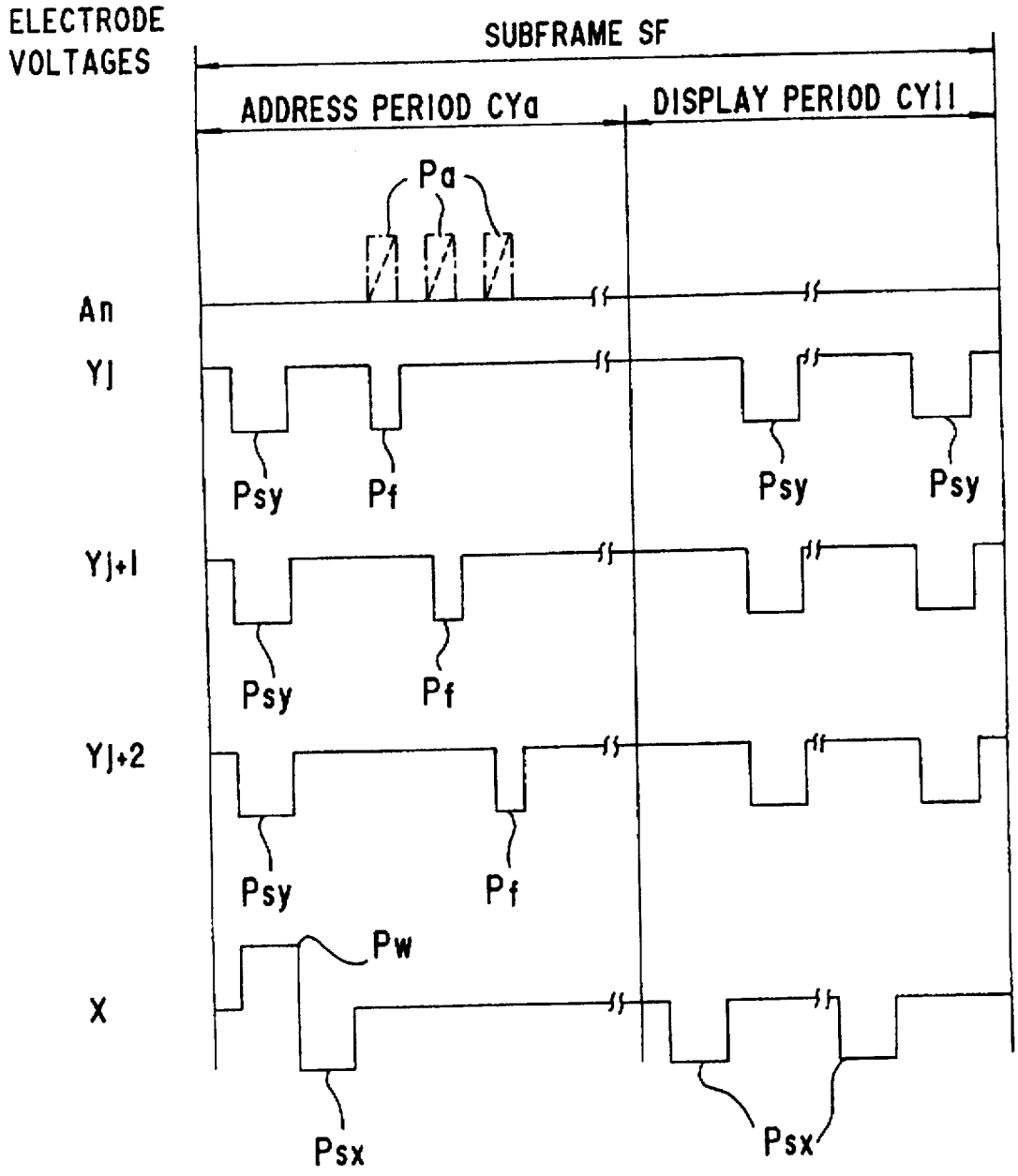
Figure 9:
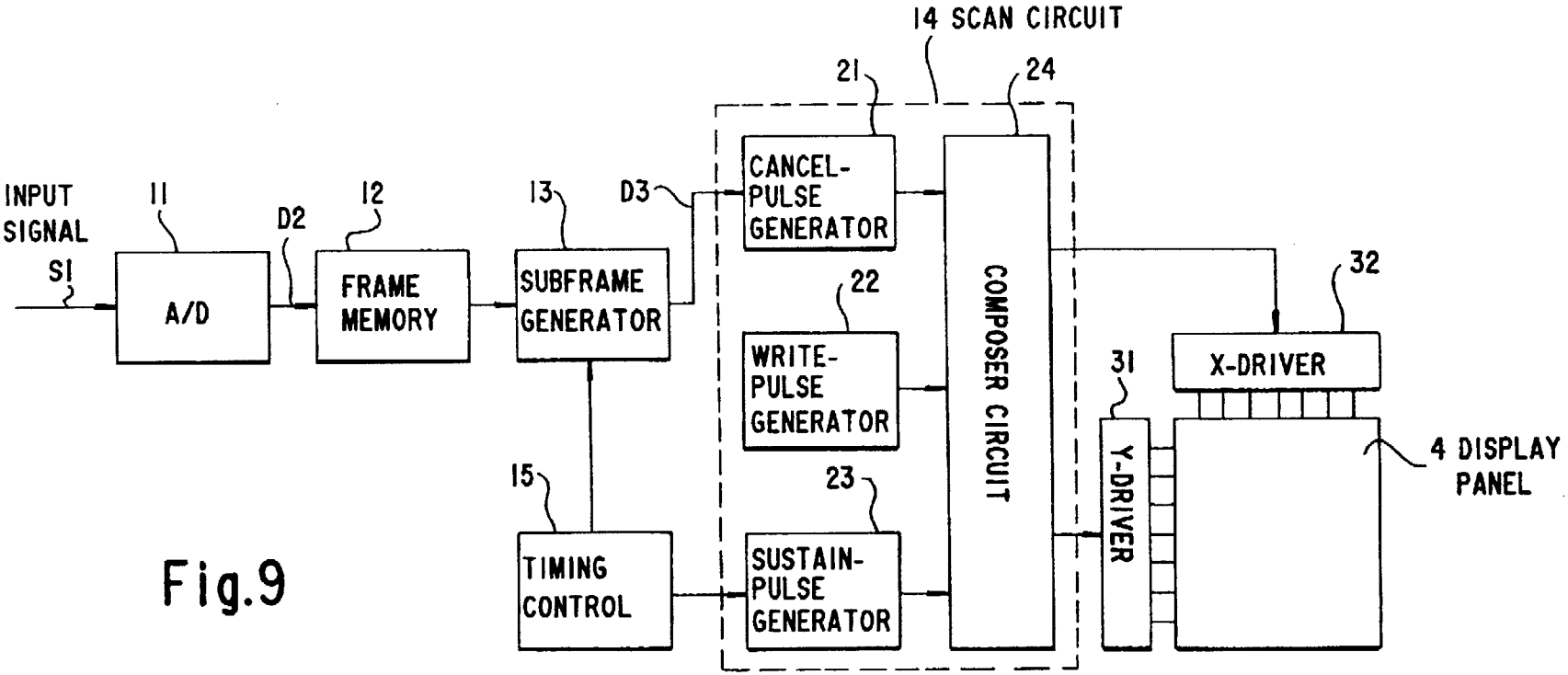
Figure 10:
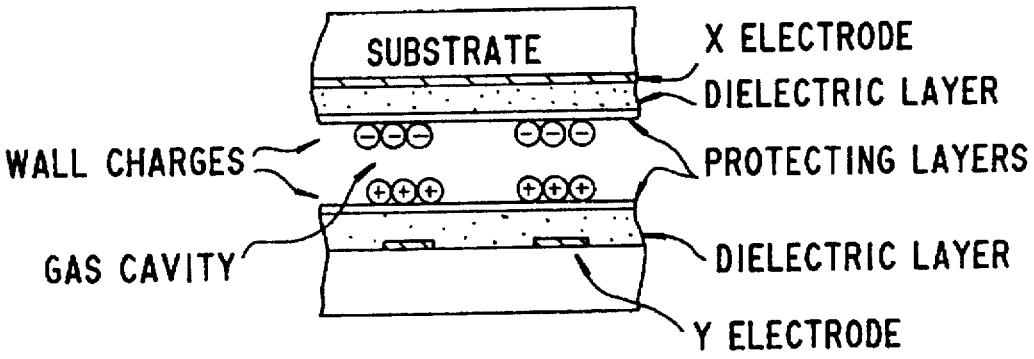
Fig.10 PRIOR ART

FIG. 6 schematically illustrates the structure of a flat display panel or an opposed-discharge type employed in the first preferred embodiment;

FIG. 7 illustrates voltage waveforms applied to Y-electrodes and X-electrodes, of a second preferred embodiment;

FIG. 8 schematically illustrates the structure of a flat display panel of a surface discharge type employed in the second preferred embodiment;

FIG. 9 schematically illustrates a block diagram of a driving circuit configuration according to the present invention;

FIG. 10 shows a wall charge; and

Figure 11:
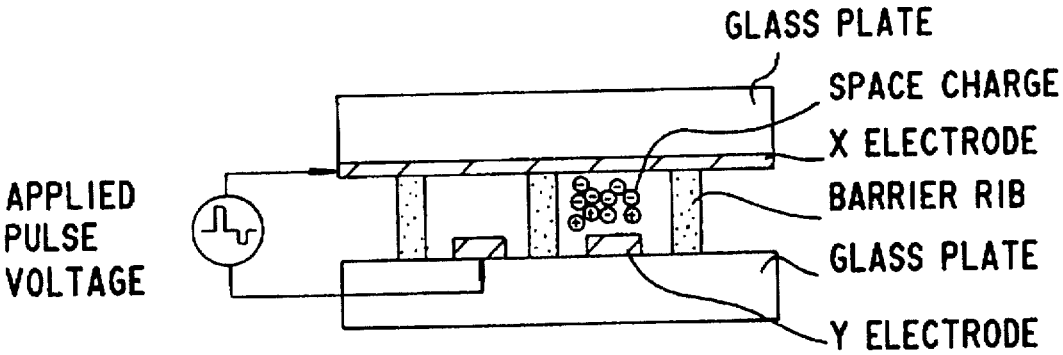
Fig.11 PRIOR ART

FIG. 11 shows a space charge.

DESCRIPTION OF THE PREFERRED EMBODIMENT

FIG. 3 schematically illustrates a frame structure of a first preferred embodiment of the present invention. A frame FM to drive a single picture on a flat display panel, such as a PDP or an electroluminescent panel, is formed of a plurality of, for example, eight subframes SF1 to SF8. Each subframe is formed of an address period CYa and one of display periods CYi1 . . . CYi8 subsequent to each address period CYa1 . . . CYa8. In each address period CYa the cells to be lit are addressed by being written selectively from all the cells of the panel. Practical operation in the address period CYa, according to the present invention, will be described later in detail. Each display period CYi1 to CYi8 has different time length essentially having a ratio 1:2:4:8:16:32:64:128 so that different numbers of sustain pulses of same frequency are included in approximately proportional to this ratio in the display periods of the respective subframes. Visual brightness, i.e. the gradation of the brightness, of a lit cell is determined by the number of the sustain pulses accumulated for the single frame period. Thus, the gradation of 256 grades that is composed of the 8 bits can be determined for each cell by selectively operating one or a plurality of the eight subframes.

Figure 2:
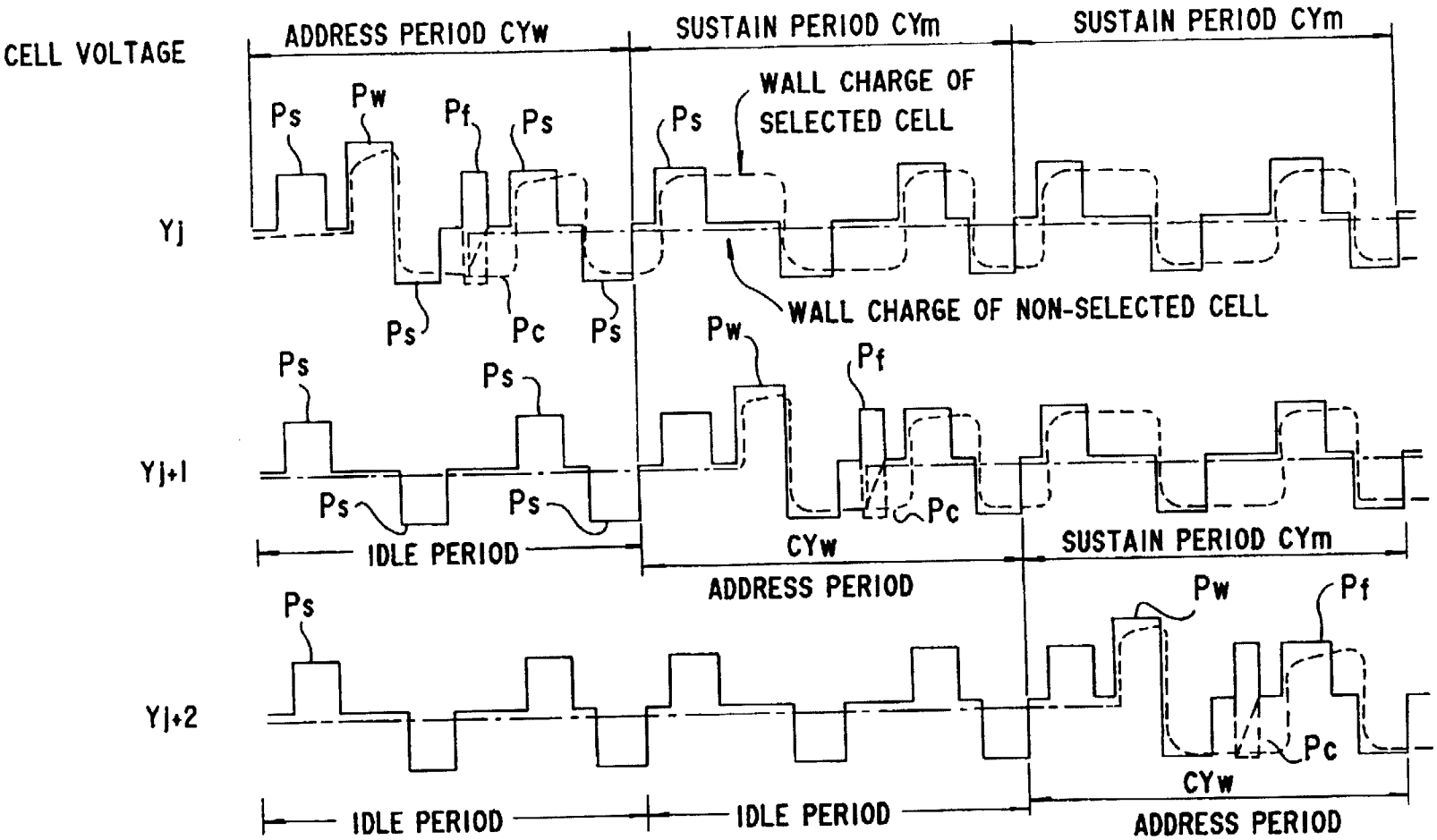
Fig.2 PRIOR ART
Figure 4:
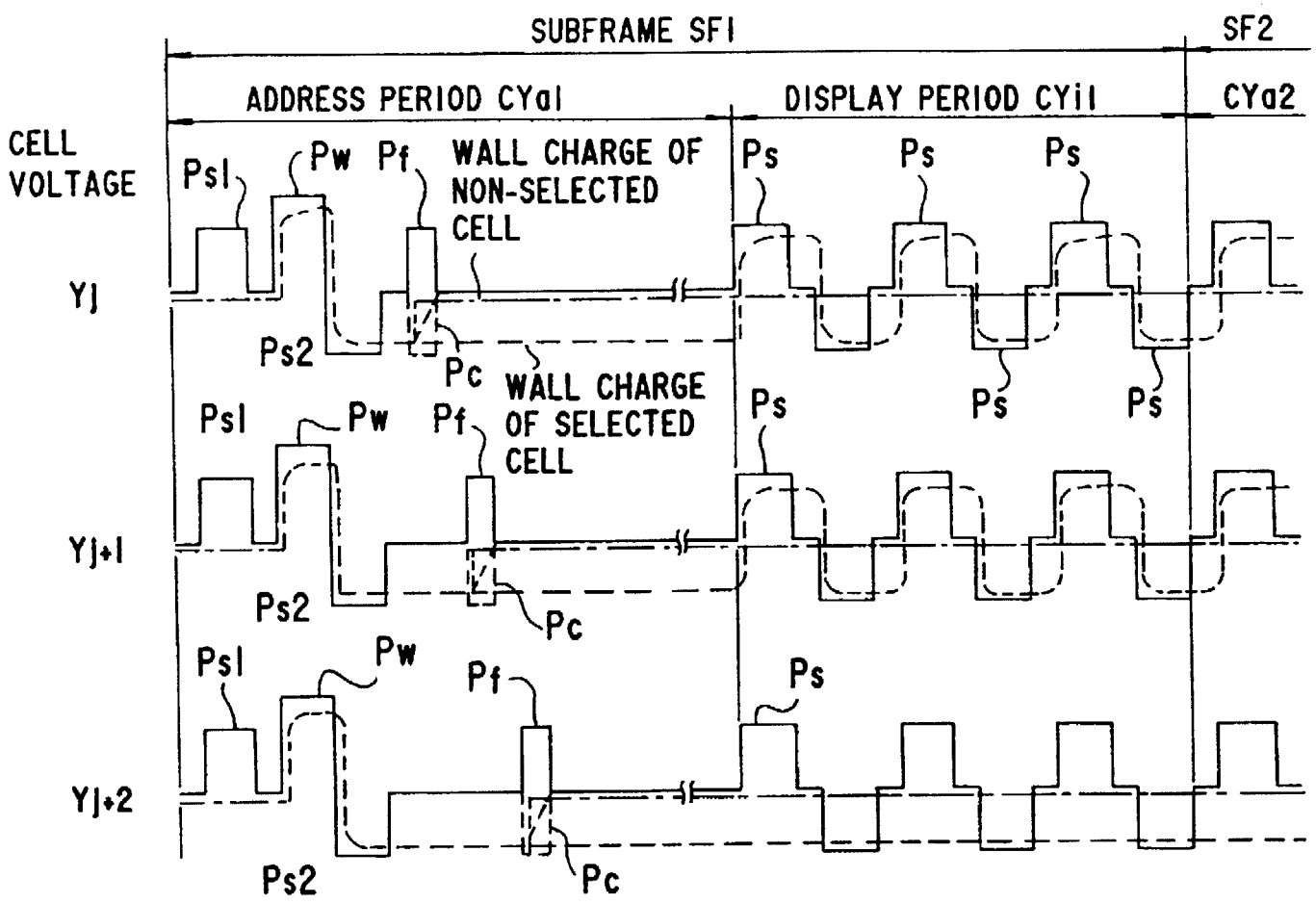
FIG. 4 illustrates waveforms of cell voltages applied across a cell on each line in a subframe.

FIG. 4 shows voltage waveforms applied across the cells of an opposed-discharge type PDP, where a discharge takes place between matrix electrodes coated with insulating layers on respective two glass panels facing each other. Layout of the matrix electrodes are schematically shown in FIG. 6, where for the present explanation of the invention the X-electrodes $X_i$, $X_{i+1}$, $X_{i+2}$ . . . are data electrodes and the Y-electrodes $Y_j$, $Y_{j+1}$, $Y_{j+2}$ . . . are scan electrodes. Cells C are formed at crossed pints of the X-electrodes and the Y-electrodes.

Figure 5:
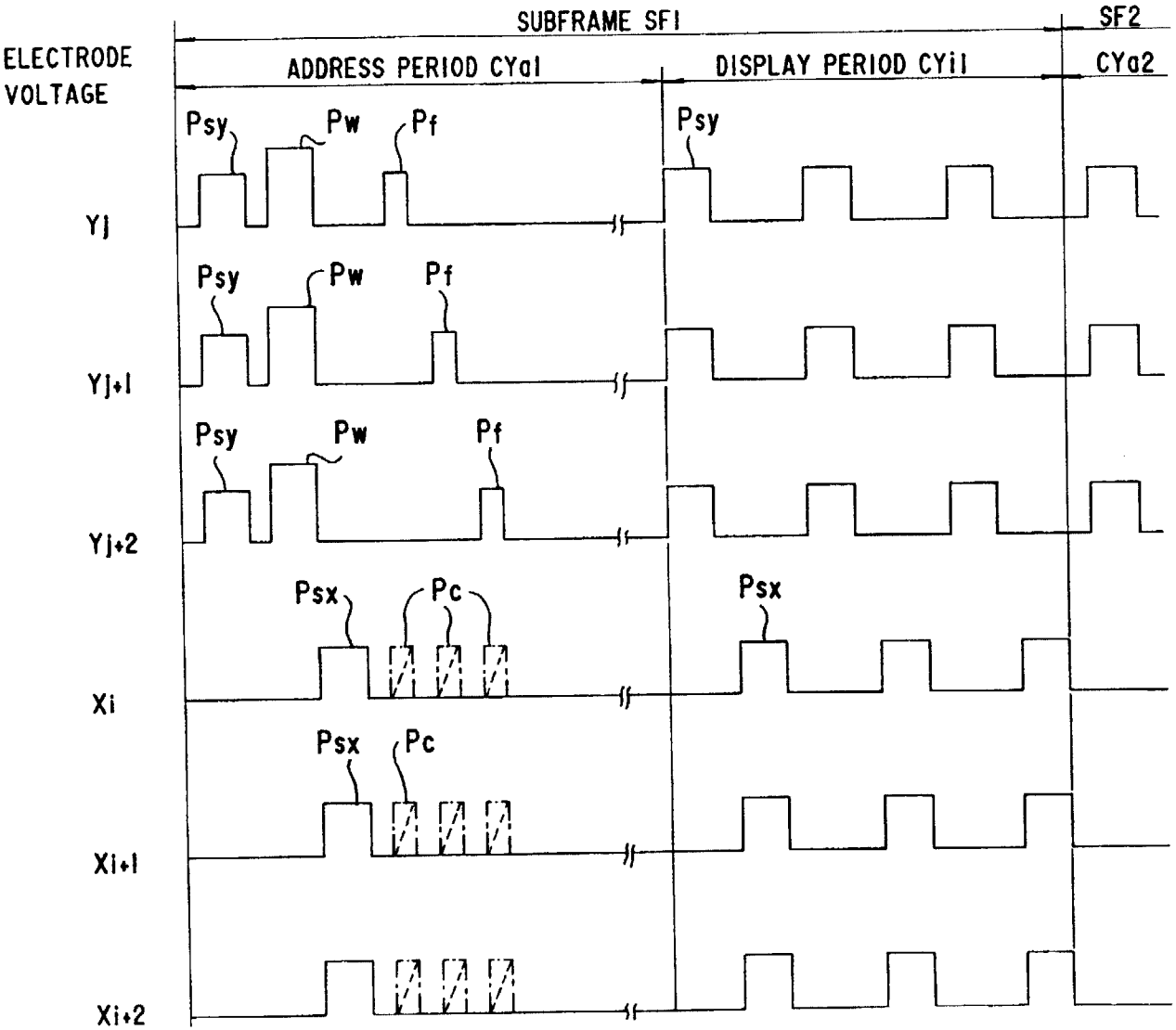
FIG. 5 illustrate voltage waveforms applied to Y-electrodes and X-electrodes, of a first preferred embodiment of the present invention.

Operation of the address period CYa is hereinafter described in detail. Voltage waveforms applied to each of X-electrodes and the Y-electrodes to compose the cell voltages of FIG. 4 are shown in FIG. 5. A sustain pulse Ps1 is applied to all the Y-electrodes in the same polarity as the subsequent write pulse, in other words, the prior sequence of sustain pulses ends at a sustain pulse having the polarity of the write pulse. Sustain pulses are typically 95 volt high and 5 μs long. Next, approximately 2 μs later a write pulse Pw is applied to all the cells by applying a pulse Pw concurrently to all the Y-electrodes while the X-electrodes are kept at 0 volt, where the write pulse Pw is typically 150 volt high and 5 μs long adequate for igniting a discharge as well a forming a wall charge (see FIG. 10), as a memory medium, in all the cells. Immediately subsequent to the write pulse Pw, a second sustain pulse Ps2 having the polarity opposite to that of the write pulse Pw is applied to all the cells by applying the sustain pulse voltage Psx to all the X-electrodes while the Y-electrodes are kept at 0 volt, in order to invert the wall charge by which the subsequent erase pulse Pf can be effective. Next, an erase pulse Pf of typically 95 volt and 0.7 to 1 μs is applied sequentially to each of the Y-electrodes, which, in other words, are now scanned. Concurrently to the erase pulse application, a cancel pulse Pc having substantially the same level and the same width as the erase pulse Pf is selectively applied to an X-electrode connected to a cell to be lit, in order to cancel the function of the erase pulse Pf. Though a cell to which no cancel pulse is applied is lit once by the front edge of the erase pulse Pf; the pulse width is not so long as to accumulate an adequate wall charge to provide the memory function. That is, the wall charge is erased so that the cell is addressed not to be lit later. Now the writing operation, which has addressed the cells to be lit by canceling the function of the erase pulse, is completed throughout the panel. Thus, the address period is approximately 621 μs long for a 400-line picture. If sustain pulse Ps1 is not applied, in other words, if the display period ends at the sustain pulse having the polarity to the write pulse, the change in the cell voltage on application of the write pulse is as large as the sum of the voltage levels of the sustain pulse and the write pulse. This large change in the cell voltage may cause a deterioration of insulation layers of the cell. Thus, the sustain pulse Ps1 is preferably introduced into the address period, but not absolutely necessary. In address cycles, all the cell are lit three times by the sustain pulse Psy, the write pulse Pw and the erase pulse Pf; however, these lightings are negligible compared with larger number of the lightings in the display cycles.

A first display period CYi1 provided subsequently to the first address period CYa1 is approximately 46 μs long. The sustain pulses are typically 5 μs wide having typically a 2 μs interval therebetween; therefore, three pairs of the sustain pulses or frequency 71.4 kHz are included in the first display period CYi1. The sustain pulses are applied to all the cells by applying the sustain pulse voltage Psy to all the Y-electrodes, and on the next phase by applying the sustain pulse voltage Psx to all the X-electrodes. Then, the cells having been addressed, i.e. having the wall charged, in the first address period CYa1 are lit at the by the sustain pulses in the subsequent subframe CYi1. The first subframe SF1 is now completed.

In the second address period CYa2 of the second subframe SF2 subsequent to the first display period CYi1, the cells to be lit during the second display period CYi2 are addressed in the same way as the first address period. The second display period CYi2 subsequent to the second address period CYa2 is approximately 91 μs long to contain 6 pairs of sustain pulses.

In the further subsequent subframes SF3 . . . SF8, the operations are the same as those of the first and second subframes SF1 and SF2; however, the time length and the number of the sustain pulses contained therein are varied as calculated below:

a frame period of 60 frames per second: 16.666 ms;

address period as described above: 621 μs;

total time length occupied by address periods of 8 subframes: 621×8=4.968 μs;

time length allowed for 8 display periods: 16,666–4,968=11,698 μs;

time length to be allocated to a minimum unit of 256 grades (represented by 8 bits): 11,698/256=45.67 μs;

time length TL of each display period of other subframes: TL=45.67×2, 4, 8, 16, 32, 64 and 128 μs, respectively;

accordingly,

| display period time length: | | number of sustain pulse pairs: |
|---|---|---|
| 1 st SF | approx. 45 μs | approx. 3 |
| 2 nd SF | 91 | 6 |
| 3 rd SF | 182 | 13 |
| 4 th SF | 365 | 26 |
| 5 th SF | 730 | 52 |
| 6 th SF | 1,461 | 104 |
| 7 th SF | 2,924 | 209 |
| 8 th SF | 5,845 | 418 |
| | | total 831 |

frequency of sustain pulses having a 14 μs period: 1/14 μs =71.4 kHz

Accordingly, total number of sustain pulse pairs in a second is 831×60=49,860, which is sufficient to provide the brightness of the maximum gradation.

Though in the above preferred embodiment the periods of the display periods are different to provide different numbers of sustain pulses; the display period may be allocated constantly to each subframe, for example, 11,698 μs/8=1,462 μs during which different numbers of the sustain pulses are contained, respectively. For varying the sustain pulse numbers, the frequency may be varied for each, subframe, such as 0.75, 1.5, 3, 6, 12, 24, 48 and 96 kHz, where the number of sustain pulse pairs are 1, 2, 4, 8, 17, n35, 70 and 140, respectively. In the constant time length 1,462 μs of the display periods, sustain pulses may be of a constant frequency, such as 96 kHz where unnecessary pulses are killed so as to leave necessary number of sustain pulses in each display periods.

A second preferred embodiment of the present invention, applied to a surface discharge type PDP, is hereinafter described. The surface discharge type PDP is such that widely known as disclosed in Japanese Unexamimed Patent Publication Tokukai Sho57-78751 and 61-39341, or schematically illustrated in FIG. 8. A plurality of X-electrodes X, each of which is parallel to and close to each or a plurality of Y-electrodes $Y_j$, $Y_{j+1}$, $Y_{j+2}$ and address electrodes An, An+1, An+2 . . . orthogonal to the X and Y electrodes are arranged on a surface of a panel. Electrodes crossing each other are insulated with an insulating layer. An address cell Ca is formed at each of the crossed points of the Y-electrodes $Y_j$, $Y_{j+1}$, $Y_{j+2}$ and the address electrodes An, An+1, An+2 . . . .Display cells Cd are formed between the Y-electrode and the adjacent X-electrode, close to the corresponding address cells Ca, respectively. Voltage waveforms applied to X-electrodes X, Y-electrodes $Y_j$, $Y_{j+1}$, $Y_{j+2}$ and address electrode An are shown in FIG. 7. An address period CYa is performed concurrently on all the Y-electrodes. In address periods, a write pulse Pw typically 5 μs long and 90 volt high is applied to all the X-electrodes while a first sustain pulse Psy1 that is opposite to the write pulse Pw, typically 5 μs long and 150 volt high, is applied to all the Y-electrodes, and the address electrodes are kept at 0 volt. Accordingly, all the display cells Cd are discharged by the summed cell voltage 240 V=90 v+150 V. Next, immediately subsequent to the write pulse a second sustain pulse Psx typically 5 μs long and 150 volt opposite to the write pulse Pw is applied to all the X-electrodes, so that a wall charge is generated in each display cell Cd and a part of the associated address cell Ca.

Next, an erase pulse Pf typically 150 volt high and 3μ long is applied sequentially to each of the Y-electrodes in the same manner as the first preferred embodiment. Concurrently to the erase pulse application, an address pulse Pa typically 90 volt high and 3μ long is selectively applied to an address-electrode of a display cell Cd not to be lit later in the subsequent display period CYi1 in the same way as that of the first preferred embodiment, whereby the wall charge is erased. At a cell to which no address pulse is applied, the wall charge is maintained. Thus, the cells to be lit later are addressed throughout the panel by maintaining the wall charge in the selected cells.

In a first display period CYi1 subsequent to the first address period CYa1 sustain pulses typically 150 volt high and 5 μs long are applied to all the cells by applying sustain pulses Psy to all the Y-electrodes and sustain pulses Psx alternately to all the X-electrodes. The cells having been addressed to have the wall charge are lit by the sustain pulsed. In the subsequent subframes the same operations are repeated as those of the first subframe except the time lengths of the display periods are different in each subframe, as the same way as that of the first preferred embodiment. The time length allocated to each subframe is identical to that of the first preferred embodiment. Accordingly, the same advantageous effects can be accomplished in the second embodiment, as well.

Though in the above preferred embodiments the time length allocation is such a manner that the first subframe has the shortest display period and the last subframe has the longest display period, it is apparent that the order of the time length allocation is arbitrarily chosen.

FIG. 9 shows a block diagram of a driving circuit of the present invention for providing gradation of the visual brightness of a flat matrix panel. An analog input signal S1 of a picture data to be displayed is converted by an A/D converter 11 to a digital signal D2. A frame memory 12 stores the digital signal D2 of a single frame FM output from A/D converter 11. A subframe generator 13 divides a single frame of picture data D2 stored in the frame memory 12 into plural subframes SF1, SF2 . . . according to the required gradation level, so as to output respective subframe data D3. A scanning circuit 14 scans a Y-electrode driver 31 and an X-electrode driver 32 of the display panel 4. The scanning circuit 14 comprises a cancel pulse generator 21 to generate the cancel pulses Pc of the first preferred embodiment as well as the address pulses Pa of the second preferred embodiment; a write pulse generator 22 to generate the write pulses Pw; a sustain pulse generator 23 to generate the sustain pulses Ps; and a composer circuit 24 to compose these signals. A timing controller 15 outputs several kinds of timing signals for, such as process timing of subframe generator 13, output timing of cancel pulse generator, and termination timing of display period in each subframe.

Operation of the gradation drive circuit is hereinafter described. The waveforms applied to the panel are the same as those already described above. In the case where the picture data each of whose pixels has n bit picture data is stored in frame memory 12 so that the picture is to be displayed by a $2^n$ gradation, subframe processor 13 sequentially outputs an n kinds of binary data D3, i.e. a pixel position data, of a picture to be exclusively formed of the respective bit of the gradation in the order of the least significant to the most significant. Depending on this picture data D3 the cancel pulse generator 21 outputs cancel pulses Pc, at the moment when a line is selected, to X-electrodes connected to the cells to be addressed to light on this selected Y-electrode. Timing controller 15 outputs a timing control signal so that the time length of each display period of subframes become a predetermined length in accordance with picture data D3 for the pixel position data output from subframe processor 13. Composer circuit 24 outputs the scan voltages shown in FIG. 5 by combining the pulse signals output from each pulse generator 21, 22 and 23 so that the address period CYa and the display period CYi can be executed in each subframe SF. The second means 14 specified in the claim is formed with cancel pulse generator 21, write pulse generator 22, sustain pulse generator 23 and composer circuit 24.

In the first and second preferred embodiments, the erase/cancel pulses as short as 1 μs require only 600 μs for addressing the cells to be lit on the 400 lines after the concurrent application of the write pulse to all the cells. Thus, the time length required for the addressing operation is drastically decreased compared with the FIG. 1 prior art method where the write pulses Pw that is as long as 5 μs occupy about 2.2 ms for individually addressing the 400 lines. As a result, the time length allowed to the display periods may be as large as 11.7 ms, which is enough to provide a 256-grade gradation. Accordingly, the driving frequency can be lowered in accomplishing the same gradation level. The lower driving frequency lowers the power consumption in the driving circuit, as well as allows longer pulse width which provides more margin in the operation reliability.

Moreover, in the present invention method solves the prior art problem in that the driving circuit configuration is complicated because the write period CYw of a line must be executed concurrently to the sustain period CYm of the other lines, accordingly, the pulses must be of very high frequency.

Furthermore, in the present invention the number of sustain pulses in each subframe can be easily chosen because the display period CYi is completely independent from the address period CYa, where the cycle of the sustain pulses does not need to synchronize with the cycle of the address cycle.

Owing to the above-described advantages, in the method and the circuit or the present invention, the gradation can be easily controlled; the ratio of the time lengths of the display periods in the subframes can be arbitrarily and easily chosen so that the gradation can meet the gamma characteristics of human eyes; accordingly, the present invention is advantageous in the freedom in designing the circuit, the production cost, and the product reliability, as well.

Though in the address period of the above preferred embodiments the addressing operation is carried out by canceling the once-written cells, it is apparent that the addressing method may be of other conventional methods where the writing operation is carried out only on the cells to be lit, without "writing-all" and "erasing-some-of-them". Even in this case, the same advantageous effect can be achieved as those of the above preferred embodiments.

Though only a single example of the circuit configuration is disclosed above as a preferred embodiment, it is apparent that any other circuit configuration to embody the spirit of the present invention may be employed.

Though only two examples of the driving waveforms are disclosed above in the preferred embodiments, it is apparent that other waveforms to embody the spirit of the present invention may be employed.

Though only two examples of the electrode configuration of the display panel are disclosed above in the preferred embodiments, it is apparent that other electrode configurations to embody the spirit of the present invention may be employed.

Though in the above preferred embodiments an AC-type PDP is referred to where the memory medium is formed of a wall charge, it is apparent that the present invention may be embodied in other flat panels where the memory medium is formed of a space charge (see FIG. 11), such as a DC-type PDP, an EL (electroluminescent) display device, or a liquid crystal device.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, It is not detailed to limit the invention and accordingly, all suitable modifications are equivalents may be resorted to, falling within the scope of the invention.

What I claim is:

1. A method of driving a matrix display panel having a plurality of pixels arranged in a plurality of lines, each of said pixels having a memory function, said method comprising the steps of:

dividing a period of a frame displaying a single picture into a plurality of subframes, wherein lines are concurrently activated in each subframe, each subframe including an addressing period for addressing a pixel by selectively forming a memory medium according to said memory function in a selected one of the pixels on each sequentially selected one of all the lines; and a display period, subsequent to said addressing period, for lighting said addressed pixel by a concurrent application of sustain pulses to all the pixels, each subframe being allocated with a predetermined number of said sustain pulses so as to weight a gradation to said respective subframe, wherein a gradation of visual brightness of said lit pixel is determined by selectively operating said subframe for each of said pixels for each frame.

2. A method as recited in claim 1, wherein said addressing period comprises the steps of:

applying a write pulse to all the pixels so as to form a memory function in each of said pixels; and selectively erasing said memory function.

3. A method as recited in claim 2, wherein said addressing period comprises the steps of:

applying a write pulse concurrently to all the pixels; and selectively erasing said memory function on a selected one of said lines.

4. A method as recited in claim 1, wherein a number of sustain pulses in said subframe is determined by a time length of said display period containing sustain pulses of a constant frequency, said number of sustain pulses being different for each subframe.

5. A method as recited in claim 1, wherein said number of sustain pulses in said subframe is determined by a frequency of sustain pulses applied in said display period, said frequency is different for each subframe.

6. A method as recited in claim 1, wherein said memory medium is formed of a wall charge in a pixel of said display panel.

7. A method as recited in claim 6, wherein said display panel is an AC-type display panel.

8. A method as recited in claim 1, wherein said memory function is formed of a space charge in said pixel of said display panel.

9. A method as recited in claim 8, wherein said display panel is a DC-type display panel, an electroluminescent panel or a liquid crystal display panel.

10. A driving circuit for providing a gradation of visual brightness of a matrix flat display panel formed of a plurality of pixels arranged in a plurality of lines, each of said pixels having a memory function, said driving circuit comprising:

first means for dividing with time a single frame to be displayed on the panel into a plurality of subframes wherein lines are concurrently activated in each subframe;

second means for selectively operating said subframes for each of said pixels, said second means comprising a means for forming a memory medium according to said memory function in said pixels during an address period, and a means for lighting said pixels having said memory medium formed therein during a display period by concurrently applying sustain pulses to all pixels subsequent to said address period, each subframe including a predetermined number of sustain pulses in each display period, wherein-the gradation of visual brightness of the pixel is determined by accumulation of time lengths of display periods of said selectively operated subframes through said single frame.

11. A method of driving a matrix display panel, formed of a plurality of pixels arranged in a plurality of lines, each pixel being capable of having a charge accumulated therein, said method comprising the steps of:

dividing a period of a frame displaying a single picture into a plurality of subframes wherein lines are concurrently activated in each subframe, each subframe including an addressing period, for addressing a pixel to be selected by applying a write pulse concurrently to all the pixels, and applying an erase pulse sequentially to each unselected one of the pixels, and a display period for lighting said selected pixels by a concurrent application of sustain pulses to all the pixels, each subframe being allocated with a predetermined number of said sustain pulses so as to weight a gradation to said respective subframe, wherein a gradation of visual brightness of said lit pixel is determined by selectively operating said subframe for each of said pixels for each frame.

12. A method of driving a matrix display panel, formed of a plurality of pixels arranged in a plurality of lines, each pixel being capable of having a charge accumulated therein, said method comprising the steps of:

dividing a period of a frame displaying a single picture into a plurality of subframes wherein lines are concurrently activated in each subframe, each subframe including an addressing period for addressing a pixel by selectively applying a write pulse to each selected one of the pixels, said write pulse forming a memory medium in a selected one of all the pixels, and a display period for lighting said addressed pixel by a concurrent application of sustain pulses to all the pixels, each subframe being allocated with a predetermined number of said sustain pulses so as to weight a gradation to said respective subframe, wherein a gradation of visual brightness of said lit pixel is determined by selectively operating said subframe for each of said pixels for each frame.

13. A method of driving a matrix display panel having a plurality of pixels arranged in a plurality of lines, each of said pixels being capable of storing display data by having a charge remaining therein, said method comprising the steps of:

dividing a period of a frame displaying a single picture into a plurality of subframes, each subframe including an addressing period for addressing a pixel by selectively forming said charge in a selected one of the pixels on each sequentially selected one of all the lines;

a display period, subsequent to said address period, for lighting said addressed pixel by a concurrent application of sustain pulses to all the pixels, each subframe being allocated with a predetermined number of said sustain pulses, so as to weight a gradation to said respective subframe, wherein said address period and display period of each subframe are respectively concurrent to all the lines in the single picture, and a gradation of visual brightness of said lit pixel is determined by selectively operating said subframe for each of said pixels for each frame.

14. A method of driving a surface discharge type plasma display panel including:

a plurality of address electrodes; and a plurality of pairs of parallel and adjacent first (Y) and second (X) electrodes, for respectively defining a plurality of display lines;

wherein said first and second display electrodes are orthogonal to said address electrodes, address cells are formed at points where the first display electrodes cross said address electrode; display cells are formed between each pair of first and second display electrodes in a vicinity of respective associated address cells, and a display cell together with the associated address cell in its vicinity constitute a pixel of the matrix display; and a selected pixel is addressed during an address period by forming a wall charge at said selected pixel and the selected pixel is lit up during the display period by application of sustain pulses to said selected pixel via the corresponding pair of first and second display electrodes, said method comprising the steps of:

dividing period of a frame displaying a single picture into a plurality of subframes, each subframe having a concurrent addressing period and a concurrent display period for all display lines, said addressing period concurrent to all of said display lines of said single picture, for addressing a pixel by selectively forming a memory medium according to said memory function in a selected one of the pixels on each sequentially selected one of all the display lines;

said display period, subsequent to said addressing period, for lighting said addressed pixel by a concurrent application of sustain pulses to all the pixels, each subframe being allocated with a predetermined number of said sustain pulses, and each subframe including a different one of said allocated numbers so as to weight a gradation to said respective subframe, wherein a gradation of visual brightness of said lit pixel is determined by selectively operating said subframe for each of said pixels for each frame.

15. A method of driving a matrix display panel having a plurality of pixels arranged in a plurality of lines, each of said pixels having a memory function, said method comprising the steps of:

dividing a period of a frame displaying a single picture into a plurality of subframes, each subframe having a concurrent period for all lines and including an addressing period for addressing a pixel by selectively forming a memory medium according to said memory function in a selected one of the pixels on each sequentially selected one of all the lines; and a display period, subsequent to said addressing period, for lighting said addressed pixel by a concurrent application of sustain pulses to all the pixels, each subframe being allocated with a predetermined number of said sustain pulses so as to weight a gradation to said respective subframe, wherein a gradation of visual brightness of said lit pixel is determined by selectively operating said subframe for each of said pixels for each frame.

* * * * *